US005523654A

United States Patent [19]

Sikora et al.

[11] Patent Number: 5,523,654

[45] Date of Patent: Jun. 4, 1996

[54] FLASHTUBE TRIGGER CIRCUIT WITH ANODE VOLTAGE BOOST FEATURE

[75] Inventors: Thomas R. Sikora; Richard J. Garling, both of Mesa, Ariz.

[73] Assignee: Tomar Electronics, Inc., Gilbert, Ariz.

[21] Appl. No.: 261,287

[22] Filed: Jun. 16, 1994

[51] Int. Cl.[6] ..... H05B 37/00

[52] U.S. Cl. ..... 315/241 R; 315/241 P; 315/241 S; 315/219

[58] Field of Search ..... 315/241 R, 241 P, 315/241 S, 219, 224, 200 A

[56] References Cited

U.S. PATENT DOCUMENTS 3,417,306 12/1968 Knak .
4,321,507 3/1982 Bosnak ..... 315/241 R
4,682,081 6/1987 Sikora ..... 315/219
4,900,990 2/1990 Sikora ..... 315/241

OTHER PUBLICATIONS

1992 Heimann Optoelectronics Flashtube Guide:

*Primary Examiner*—Robert J. Pascal
*Assistant Examiner*—Haissa Philogene
*Attorney, Agent, or Firm*—Cahill, Sutton & Thomas

[57] ABSTRACT

This circuit facilitates the triggerability of a remote three wire flashtube and trigger coil assembly at a much lower than normal anode power supply voltage. The discharge of the trigger capacitor produces the usual trigger-event in the trigger coil. Simultaneously, a trigger boost capacitor boosts the flashtube anode voltage to approximate the supply voltage plus the voltage across the trigger coil primary winding. As a result, the flashtube anode voltage is essentially doubled at the outset of each trigger event.

10 Claims, 5 Drawing Sheets

FLASHTUBE TRIGGER CIRCUIT WITH ANODE VOLTAGE BOOST FEATURE

BACKGROUND OF THE INVENTION

1. Field of the Invention

The present invention relates to electrical trigger circuits for gaseous discharge flashtubes, and more particularly, to trigger circuits for flashtubes that must be triggered reliably at low anode power supply voltages.

2. Description of the Prior Art

As illustrated in FIGS. 2 and 2B, prior art flashtube trigger circuits generally trigger flashtubes by applying a high voltage pulse to the flashtube gas by either a direct series triggering method of injecting a high voltage pulse in series with the flashtube anode or cathode circuit or by a capacitively coupled external trigger method. FIG. 2A depicts the flashtube anode voltage waveform during the trigger event of FIG. 2.

The minimum cathode to anode operating voltage of a flashtube is determined by lamp element geometry, gas fill pressure and lamp construction materials. Flashtube discharge is initiated by the application of a high voltage trigger pulse greater than the static breakdown voltage of the tube, generally ranging between 2000 to 20,000 volts. The difference between the trigger voltage and the lamp operating voltage must be sufficient to avoid spontaneous triggering. A ratio of 10:1 minimum is typically used to prevent spontaneous triggering.

The direct series triggering method utilizes a large trigger transformer with a secondary winding connected in series with either the lamp cathode or anode to inject a high voltage pulse when a semiconductor or mechanical switch is closed to initiate a trigger event. Closure of the trigger switch discharges a small trigger capacitor through the trigger transformer primary winding which induces a damped high voltage oscillation in the secondary winding. Direct series trigger components are large and costly because they must carry the full flashtube electrode current. The maximum anode voltage applied to the flashtube during the trigger event is the sum of the voltage of the power supply energy storage capacitor and the trigger transformer voltage.

The capacitivity coupled external triggering method is used with flashtubes that have an external trigger electrode fastened to the flashtube which extends over the entire arc length of the tube.

The external trigger electrode forms a capacitance of approximately 10 pf against the cathode and anode of the lamp. As a result, a small pulse transformer with a transformation ratio of 1:20 to 1:100 is used to generate a high voltage pulse when a semiconductor or mechanical trigger switch is closed to start a trigger event. The resulting discharge of the small trigger capacitor into the trigger transformer primary winding produces a damped high voltage oscillation in the secondary winding. The maximum anode voltage applied to the flashtube during the trigger event by this circuit equals the power supply energy storage capacitor voltage.

Other prior art variations of the capacitive external triggering method provide an increase in flashtube cathode to anode voltage during a trigger event by using an auxiliary anode voltage supply having an output voltage higher than the power supply energy storage capacitor voltage to assist lamp triggering. U.S. Pat. No. 4,900,990 teaches capacitive triggering with an external anode boost voltage source. Page 7 of the 1992 Heimann Optoelectronics Flashtube Guide teaches the use of a voltage doubling circuit that requires four electrical connections to the lamp assembly and a diode and small capacitor to increase the apparent anode voltage on the lamp during the trigger event.

As illustrated in FIG. 3, the prior art voltage doubler taught by Heimann requires four electrical connections to the remote lamp assembly and therefore will not work with the large number of three wire flashtube assemblies currently in use. The FIG. 3A timing diagram graphically represents the anode voltage change during a trigger event relating to the circuit illustrated in the FIG. 3 electrical schematic diagram.

SUMMARY OF THE INVENTION

It is therefore a primary object of the present invention to provide an apparatus for assisting the triggering of a remote three wire flashtube and trigger coil assembly operated at a low anode voltage by using a small coupling or boost capacitor and an isolation diode in the flashtube power supply to increase the flashtube anode voltage at the outset of each trigger event to a level higher than the flashtube power supply energy storage capacitor voltage. This feature of the invention enables capacitive external triggering of flashtubes at a power supply energy storage voltage far below the normal flashtube anode operating voltage. This unique operating mode makes it possible to operate a standard flashtube in a non-standard dim output mode by providing a trigger circuit derived, short duration anode boost voltage at the onset of each trigger event to thereby enable a flashtube to operate with a less than normal minimum anode voltage.

DESCRIPTION OF THE DRAWINGS

The invention is pointed out with particularity in the appended claims. However, other objects and advantages together with the operation of the invention may be better understood by reference to the following detailed description taken in connection with the following illustrations, wherein:

DETAILED DESCRIPTION OF THE INVENTION

Referring now to drawings of the present invention, the advantages of the invention and its contributions to the art, will be reviewed in detail.

Figure 1:
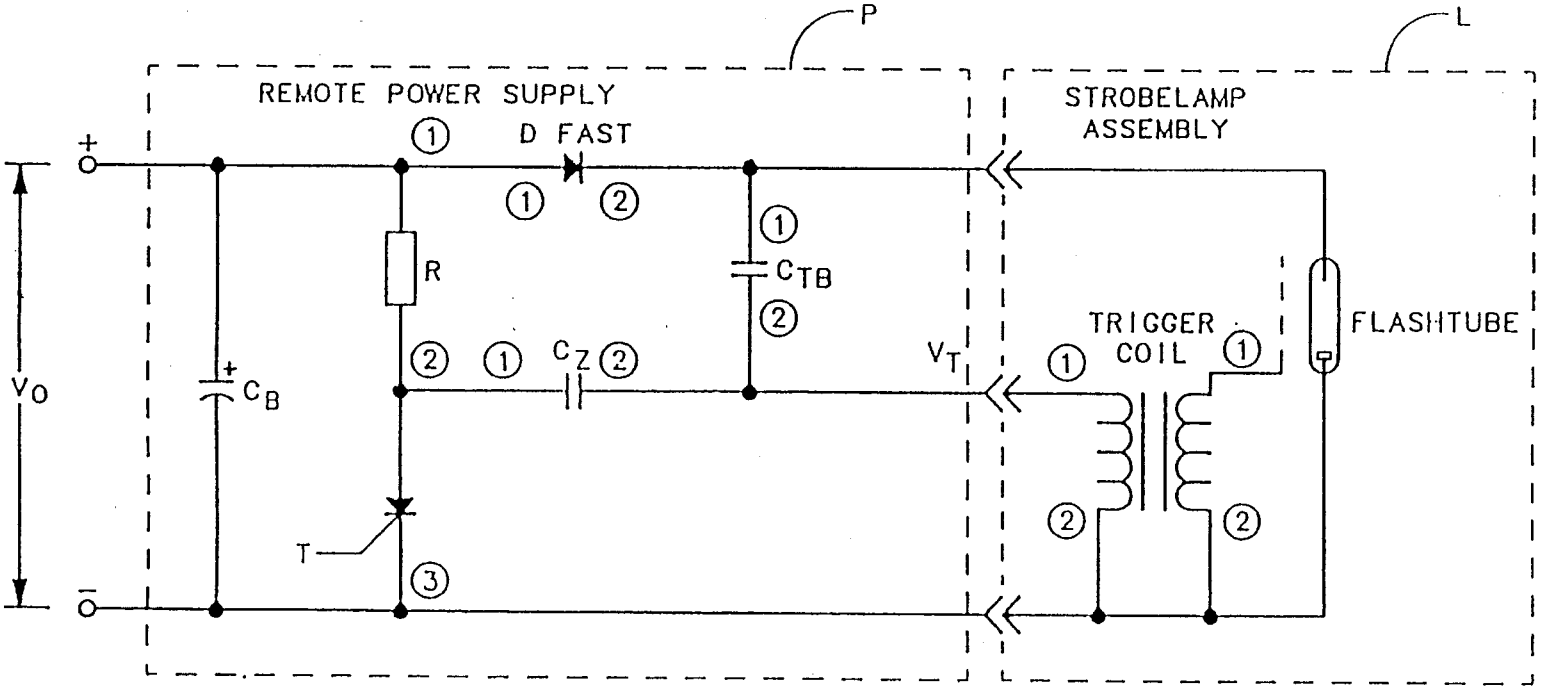
FIG. 1 is an electrical schematic diagram of a preferred embodiment of the present invention.
Figure 1A:
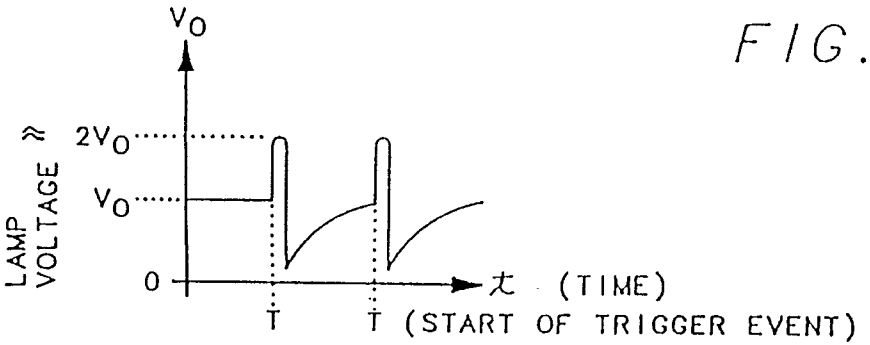
FIG. 1A is a graphical representation of the anode voltage change during a trigger event facilitated by a preferred embodiment of the present invention.
Figure 2:
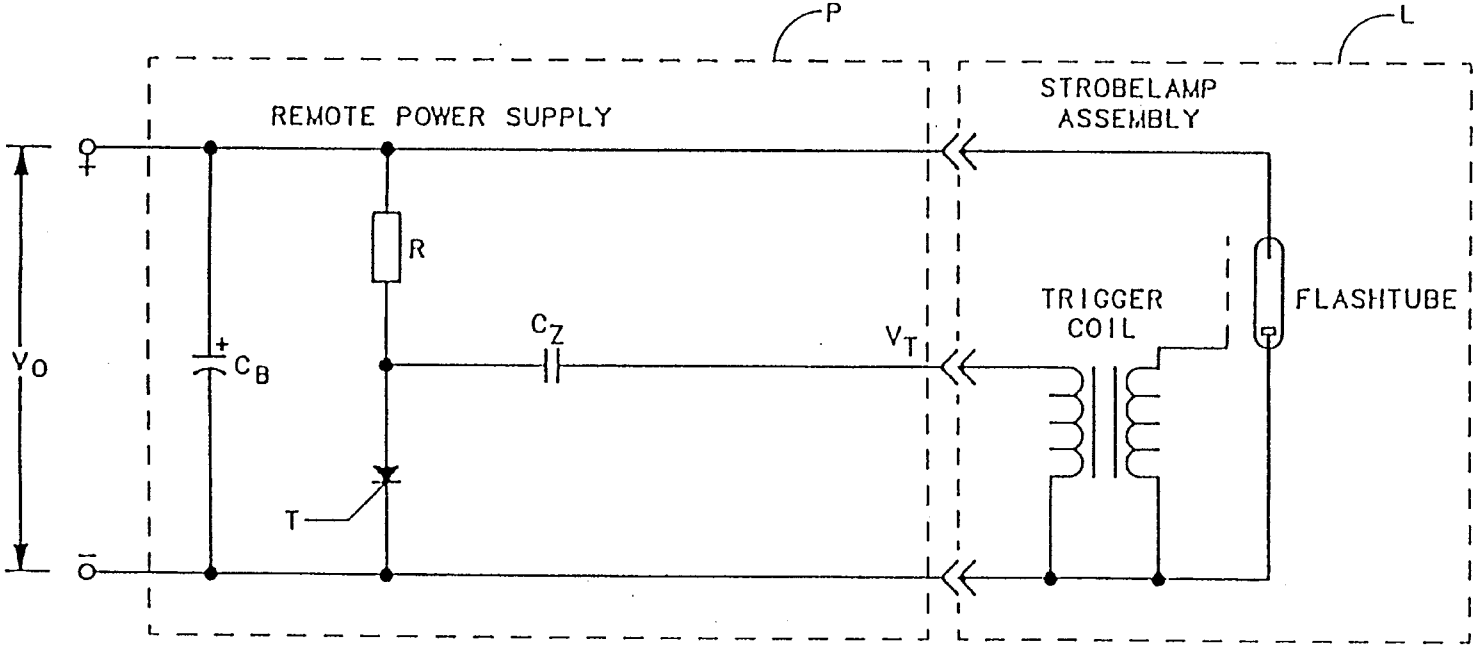
FIG. 2 (PRIOR ART)
FIG. 2 is a schematic diagram of a prior art flashtube capacitively coupled external trigger circuit.
Figure 2B:
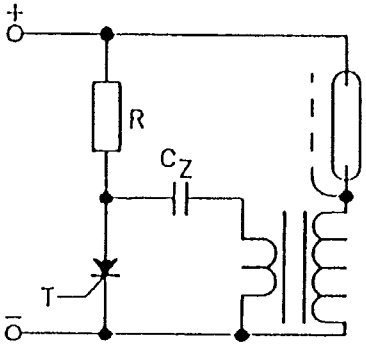
FIG. 2B (PRIOR ART)
FIG. 2B is a schematic diagram of a prior art flashtube direct series trigger circuit.
Figure 2A:
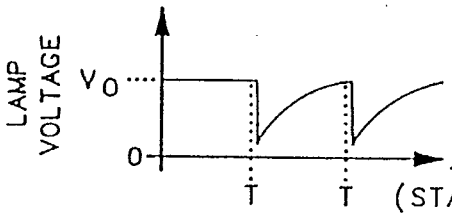
FIG. 2A is a graphical representation of the anode voltage change during the trigger event of a prior art flashtube capacitively coupled external trigger circuit.
Figure 3:
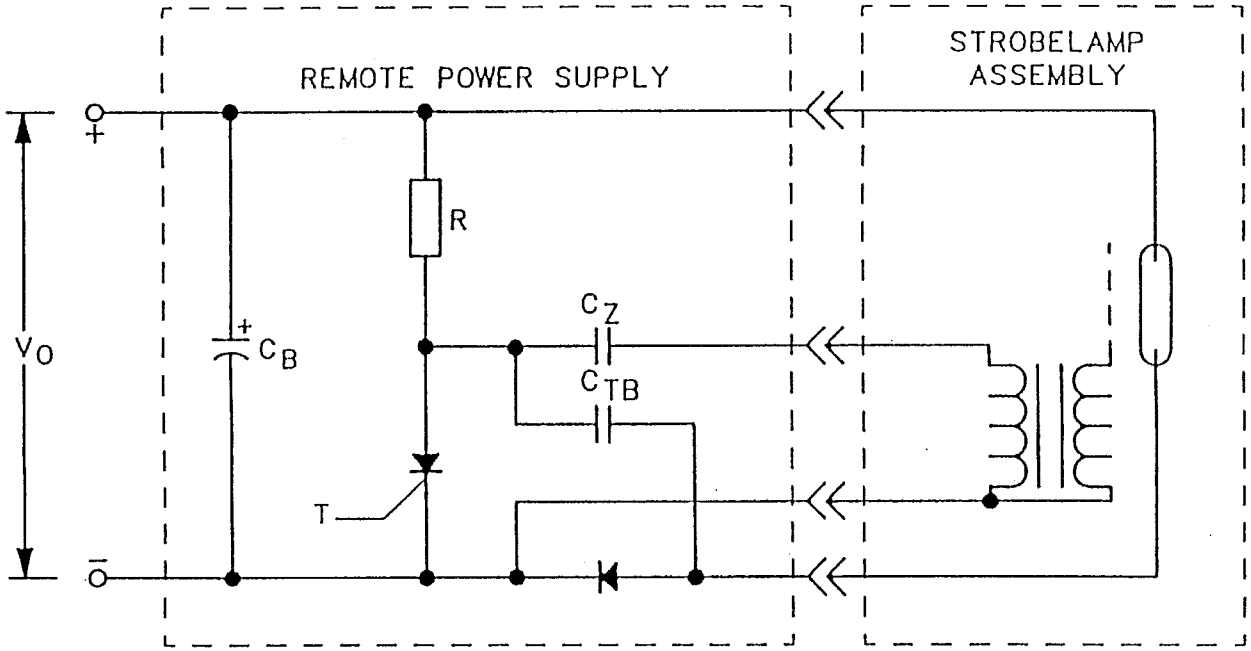
FIG. 3 (PRIOR ART)
FIG. 3 is a schematic diagram of a prior art flashtube voltage doubler circuit.
Figure 3A:
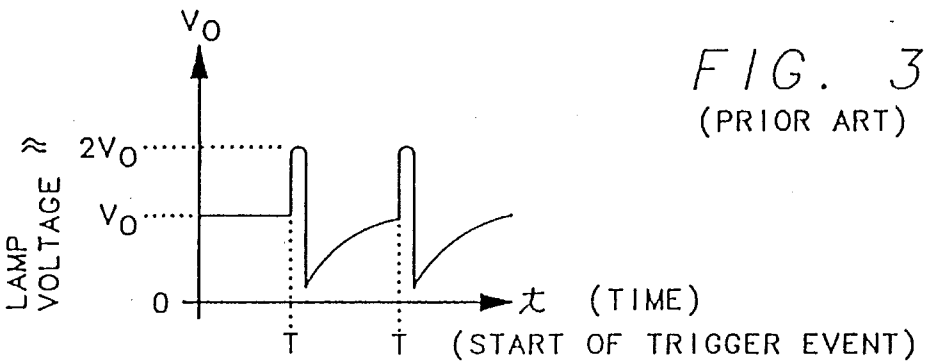
FIG. 3A is a graphical representation of the anode voltage change during a trigger event of the prior art voltage doubler circuit illustrated in FIG. 3.

Referring now to FIG. 1, the flashtube anode voltage boost circuit of the present invention includes trigger boost capacitor $C_{TB}$ and diode D which act together to temporarily increase the flashtube anode voltage during the onset of the trigger event by adding the trigger coil oscillating voltage $V_T$ stored in boost capacitor $C_{TB}$ to the power supply output or flashtube operating voltage $V_O$. Diode D should be a fast recovery type such as a Motorola MUR460 which acts to prevent the boosted anode voltage from being fed back into the energy storage capacitor $C_B$. The Motorola MUR460 diode possesses a $t_{rr}$ maximum reverse recovery time of 75 nanoseconds when $I_F$=1.0 amp. and the di/dt=50 A/microseconds and a $t_{fr}$ maximum forward recovery time of 50 ns when $I_F$=1.0 amp. and the di/dt=100 A/microsecond, with recovery to 1.0 volt.

The capacitance rating of capacitor $C_{TB}$ can be very small relative to the rating of energy storage capacitor $C_B$, and in the best mode will be approximately 0.047 uF with a voltage rating equal to at least $V_O$. The particular details and operating modes of the remainder of the strobe trigger circuit are well known in the art and have not been shown or explained in detail.

Figure 4A:
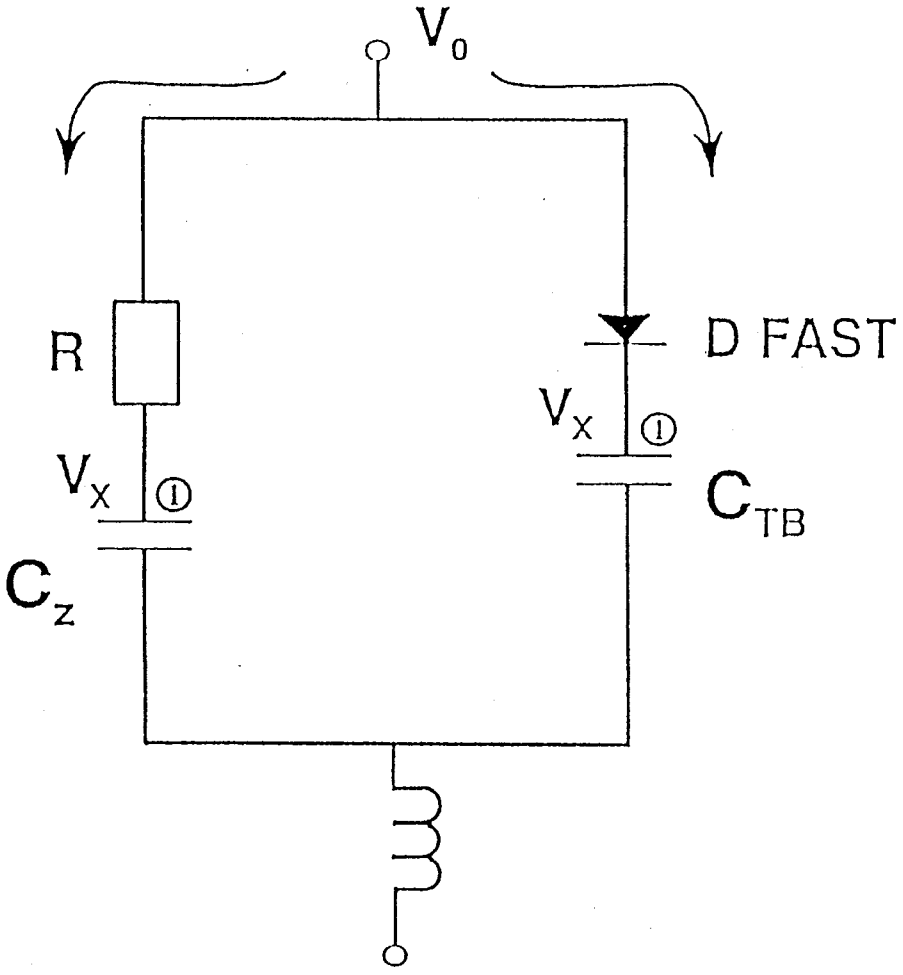
FIG. 4A illustrates the FIG. 1 flash tube trigger circuit configured into the charging state with the SCR in the open circuit configuration.
Figure 4B:
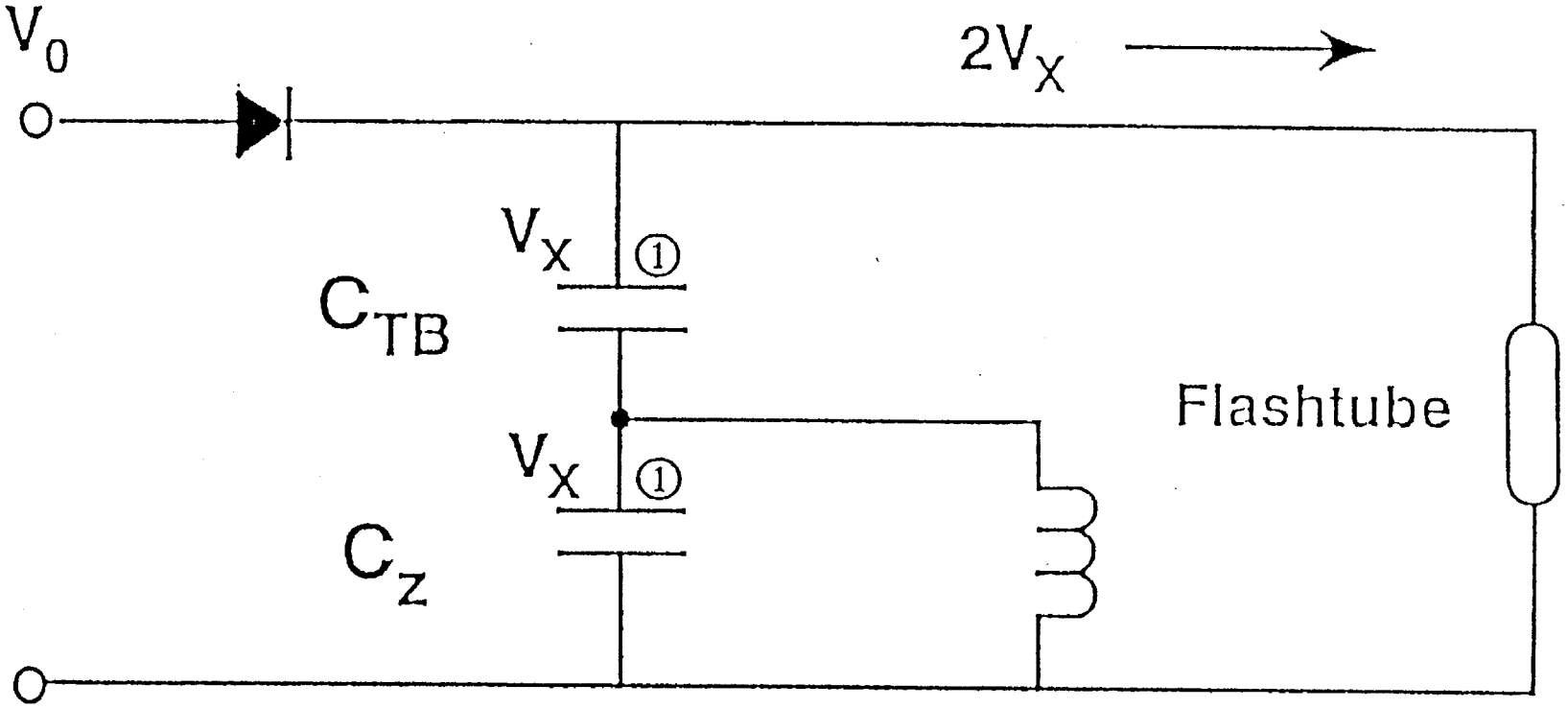
FIG. 4B illustrates the FIG. 1 flash tube trigger circuit configured into the discharge state with the SCR closed.

The FIG. 4A and 4B circuit diagrams illustrate the two state reconfiguration of the FIG. 1 flash tube trigger circuit.

FIG. 4A illustrates the trigger switch or SCR in the normally open state which allows capacitors $C_Z$ and $C_{TB}$ to be charged through resistor R and diode D FAST by power supply output voltage $V_O$.

As illustrated in FIG. 4A, when the SCR trigger switch is maintained in the open or high impedance state, trigger capacitor $C_Z$ and trigger boost capacitor $C_{TB}$ are effectively coupled in parallel. Because the isolating diode D FAST is forward biased, charging current readily flows from the power supply output terminal into $C_{TB}$.

As illustrated in FIG. 4B, when the trigger switch is closed to initiate a trigger event, trigger capacitor $C_Z$ and trigger boost capacitor $C_{TB}$ are coupled in series.

Because during the FIG. 4A charging state each capacitor $C_Z$ and $C_{TB}$ is charged to a voltage $V_X$ where $V_X$ typically approximates $V_O$, the summed output from series-connected capacitors $C_{TB}$ and $C_Z$ in the FIG. 4B discharge state will equal 2 $V_X$, or approximately 2 $V_O$, where that essentially doubled power supply output voltage is applied across the flashtube anode and cathode terminals as illustrated in FIG. 4B.

In the FIG. 4B series-coupled state, the isolating diode is reverse biased because voltage 2 $V_X$ substantially exceeds power supply voltage $V_O$ to prevent unwanted discharge of the series-coupled capacitors $C_{TB}$ and $C_Z$ through the power supply.

The 1A timing diagram illustrates the SCR-controlled transition between the parallel-coupled capacitor charging state and the series-coupled capacitor discharge state which temporarily generates a flashtube anode to cathode voltage approximately equal to 2 $V_0$.

It has been found that the anode voltage boost circuit of the present invention consisting of uniquely connected diode D and capacitor $C_{TB}$ will allow the minimum lamp anode operating voltage of a typical flashtube to be reduced from 194 VDC to 134 VDC, or approximately thirty percent, while maintaining reliable flashtube triggering.

The increase in the triggerability of the flashtube provided by the anode voltage boost circuit of the present invention can be applied in several ways:

1. The fill pressure of the flashtube can be increased (which increases the :flashtube minimum anode voltage operating parameters) to increase the efficiency of the flashtube thereby increasing its light output while using the same input power.

2. The operating voltage $V_O$ of the energy storage capacitor can be reduced to decrease the brightness of the flashtube thereby allowing the flashtube to be operated at brightness level far below the minimum level attainable with prior art trigger circuits.

While the invention has been described in terms of a single preferred embodiment, those skilled in the art will recognize that the invention can be practiced with modifications within the spirit and scope of the appended claims.

We claim:

1. Apparatus for triggering a gaseous discharge flashtube having a gaseous interior, anode and cathode terminals and a trigger electrode and being energized by a power supply generating an output voltage $V_O$ and having first, second and third output terminals, said apparatus comprising:

a. a trigger coil including a primary winding having first and second terminals, the second terminal being coupled to the third power supply output terminal and to the flashtube cathode terminal, and further including a secondary winding having a first terminal coupled to the flashtube trigger electrode and a second terminal coupled to the third power supply output terminal for periodically applying a high voltage trigger pulse to the flashtube trigger electrode;

b. an isolating element coupled between the second and third power supply output terminals;

c. a trigger capacitor having a first terminal coupled to the second power supply output terminal and a second terminal coupled to the first terminal of the trigger coil primary winding;

d. an isolating diode having a first terminal coupled to the first power supply output terminal and a second terminal coupled to the flashtube anode terminal;

e. a trigger boost capacitor having a first terminal coupled to the second terminal of the isolating diode and a second terminal coupled to the first terminal of the trigger coil primary winding; and f. a trigger switch coupled across the second and third power supply output terminals having a normally open state and a closed state which initiates a trigger event for isolating the second and third power supply output terminals when the trigger switch is in the open state to configure the trigger boost capacitor and the trigger capacitor in a parallel-coupled state where each capacitor is charged by the power supply to a voltage $V_x$, with charging current for the trigger boost capacitor flowing from the power supply through the isolating diode, and for connecting together the second and third power supply output terminals when the trigger switch is switched into the closed state to initiate the trigger event to reconfigure the trigger boost capacitor and the trigger capacitor into a series-coupled state with the first terminal of the trigger boost capacitor coupled to the flashtube anode terminal and with the first terminal of the trigger capacitor coupled to the flashtube cathode terminal to temporarily apply a boost voltage of 2 $V_X$ across the flashtube anode and cathode terminals while the isolating diode temporarily prevents current flow from the series-connected capacitors into the power supply.

2. The apparatus of claim 1 wherein the isolating diode includes a semiconductor diode having a maximum reverse recovery time of 75 nanoseconds and a maximum forward recovery time of less than about 50 nanoseconds.

3. The apparatus of claim 1 wherein the isolating element includes a resistor.

4. The apparatus of claim 1 wherein the trigger switch includes a mechanically actuated switch.

5. The apparatus of claim 1 wherein the trigger switch includes a semiconductor switch.

6. The apparatus of claim 5 wherein the semiconductor trigger switch includes a silicon controlled rectifier.

7. The apparatus of claim 1 wherein the flashtube includes a minimum anode voltage parameter and wherein the boosted voltage temporarily applied across the flashtube anode and cathode terminals by the series-connected trigger boost capacitor and trigger capacitor during the onset of each trigger event exceeds the flashtube minimum anode voltage.

8. The apparatus of claim 7 wherein the boost voltage decreases to zero during the remainder of each trigger event.

9. The apparatus of claims 1 or 7 wherein the boost voltage applied to the flashtube during the onset of each trigger event is substantially greater than $V_O$.

10. The apparatus of claim 9 wherein the boost voltage applied to the flashtube during the onset of each trigger event is approximately equal to 2 $V_O$.

* * * * *